United States Patent [19]

Iwai

[11] Patent Number: 4,619,516

[45] Date of Patent: Oct. 28, 1986

[54] REPRODUCING APPARATUS

[75] Inventor: Yasuyuki Iwai, Hachioji, Japan

[73] Assignee: Konishiroku Photo Industry Co., Ltd., Tokyo, Japan

[21] Appl. No.: 675,136

[22] Filed: Nov. 27, 1984

[30] Foreign Application Priority Data

Dec. 2, 1983 [JP] Japan ..... 58-228767
Dec. 2, 1983 [JP] Japan ..... 58-228768

[51] Int. Cl.[4] ..... G03G 15/00
[52] U.S. Cl. ..... 355/3 DD; 355/3 R
[58] Field of Search ..... 355/3 DD, 3 R, 15, 3 DR, 355/3

[56] References Cited

U.S. PATENT DOCUMENTS 4,376,577 3/1983 Okamoto ..... 355/3 DR
4,449,811 5/1984 Betron et al. ..... 355/3 SH

*Primary Examiner*—Arthur T. Grimley
*Assistant Examiner*—David Warren
*Attorney, Agent, or Firm*—Jordan B. Bierman

[57] ABSTRACT

A reproducing apparatus wherein a frame is divided into an upper frame having an image retainer and a developing device arranged near the image retainer for developing with toner a latent image on the image retainer, and a lower frame engaging at one portion thereof with the upper frame, and the upper frame is movable relative to the lower frame. When the upper frame is in a displaced state a pressing device for pressing the developing device to the adjacent place of the surface of the image retainer is released.

30 Claims, 5 Drawing Figures

PRIOR ART FIG. 1

REPRODUCING APPARATUS

BACKGROUND OF THE INVENTION

1. Field of the Invention

Present invention relates to a two-frame reproducing apparatus which is improved by a developing element of a developing device being provided in such a manner that it can be separated from an image forming surface.

2. Description of the Prior Art

The internal functions and the composition thereof in a conventional electrophotographic reproducing apparatus are as shown in FIG. 1.

In the diagram, recording paper P which is supplied by first paper-feeding roller 3, sheet by sheet, from a paper-feeding cassette 2 mounted on a reproducing machine 1 is inverted after passing through a sub paper-feeding roller 3*a* and reaches a second paper-feeding roller 4. The timing and speed of conveyance of the paper are adjusted so that the fore end of the paper can fall in line with the fore end of a toner image formed on a photosensitive drum 5 which will be described below.

The photosensitive drum 5, which is given an electric charge uniformly on the peripheral surface thereof by a charging electrode 6 beforehand, rotates in the direction of the arrow. Meanwhile, an image of a document D which is moved horizontally in synchronization with the peripheral velocity of said drum 5 is transmitted onto the peripheral surface of the drum 5 by an exposure lamp 7 and a converging phototransmission element (tradename: SELFOC Lens) 8, and an electrostatic latent image is formed sequentially on said surface.

With the subsequent rotation of said photosensitive drum 5, the latent image on this drum is developed into a visible toner image by the developing element of a developing device 9, i.e. a developing sleeve 9*a*.

The photosensitive drum 5 rotates further and comes in contact with said recording paper P and the toner image on the drum 5 is transferred onto the paper P by a transfer electrode 10. Thereafter the recording paper P is separated from the drum by a separation electrode 11.

The recording paper P thus separated is fed to a fixing roller 13 via a conveying roller 12, and the toner image is molten and fixed on the paper by the roller 13. Then, the paper is ejected by an ejection roller 14 from paper ejection port 15 into an ejected paper tray, not shown in the diagram, which is provided outside the reproducing machine 1.

After the separation of the recording paper P, the photosensitive drum 5 rotates further in the direction of the arrow and the electric charge thereon is eliminated by a charge elimination electrode 16. Thereafter the residual toner adhering to the drum 5 is scraped down by a cleaning blade 17*a* of a cleaning device 17, and the toner thus scraped is collected in a cleaner box 18. Meanwhile, the photosensitive drum 5 is given another electric charge by the charging electrode 6 so that another electrostatic latent image may be formed thereon from a subsequent document.

Numeral 19 denotes a port into which the recording paper is inserted when it is supplied manually to the machine, and 3*b* denotes a paper-feeding roller which operates when the paper is supplied manually.

In the electrophotographic reproducing machine having these functions, the photosensitive drum 5 which suffers deterioration of performance or damage of the surface in employment and the cleaning blade 17*a*, the performance of which tends to deteriorate with abrasion, must be replaced periodically, and a developer cartridge 9*b* must be supplied frequently with toner. Therefore, these members have removable structures. Among them, the photosensitive drum 5 is disposed very close to the developing sleeve 9*a* since the latent image on the drum 5 is developed by a developer adhering to the sleeve 9*a*, and these two members must be in close proximity to each other, particularly when a one-component developer is used. Accordingly, the greatest possible care must be taken so that the photosensitive drum is not damaged by contact between the drum 5 and the developing device 9 when either of them is mounted or removed.

To facilitate handling these members, a number of constructions have been proposed. Among them, there are a construction in which a device enabling the manual withdrawal of the developing device 9 prior to the removal of the photosensitive drum 5 is provided, a construction in which the developing device 9 is pulled out along a guide rail when it is separated from the drum 5, and a construction in which the developing device 9 is moved away from the drum 5 by utilizing a device which is used for moving the developing device 9 when the reproducing machine is warmed up, etc. Every one of these systems, however, necessitates expensive components such as a solenoid and also many structural components including a lever and others, all of which add to the cost of the device. Also all of these systems are operated manually, so that there is always a chance for accidents caused by human error.

Such problems as described above are also unavoidable for a two-frame reproducing machine in which an upper frame 1*a* is coupled with a lower frame 1*b* in such a manner that the former can be opened and closed around a hinge as the center of its rotation, as shown in FIG. 1, for convenience for replacement or repair of components, or for trouble shooting.

SUMMARY OF THE INVENTION

An object of the present invention is to provide a two-frame reproducing apparatus in which necessary handling is performed automatically without requiring any operators intervention, and in which the mechanism is simplified by a construction in which the developing sleeve of the developing device is separated and kept away automatically from the image forming surface of the photosensitive drum when the upper frame is opened.

Regarding the two-frame reproducing apparatus with its upper frame housing the photosensitive drum and the developing device, etc., so constructed that it can be opened and closed in relation to the lower frame thereof by a shaft or hinge coupling, said object of the present invention is attained by a reproducing apparatus which is constructed so that the developing device is rotated by its own weight to be separated from the photosensitive drum simultaneously when a setting member which presses the developing device to a prescribed position of a development is moved back by the opening and tilting of said upper frame. Moreover, regarding the reproducing apparatus which has its upper and lower frames separable from each other, the above object of the present invention is attained by a reproducing apparatus characterized in that it is provided with a member which sets the developing surface of the developing device at a normal position before the upper and lower frames are separated from each other, and the setting member of the developing device is released so that said developing surface is separated from the image forming surface by the own weight of the developing device when the upper frame is separated from the lower.

Furthermore, regarding the two-frame reproducing apparatus with its upper frame housing the photosensitive drum and the developing device, etc., so constructed that it can be opened and closed in relation to the lower frame thereof by the shaft coupling, the above-described object of the present invention is attained by a reproducing apparatus which is constructed so that the developing device is rotated by its own weight to move to and stop at a prescribed position as said upper frame is opened and tilted, and which is characterized in that the developing element of the developing device provided in the upper frame is separated from the image forming surface by separating the upper and lower frames from each other in the reproducing apparatus which has its upper and lower frames separable from each other.

Other objects and characteristics of the present invention will be made apparent hereunder with the description of drawings.

DESCRIPTION OF THE PREFERRED EMBODIMENTS

Figure 1:
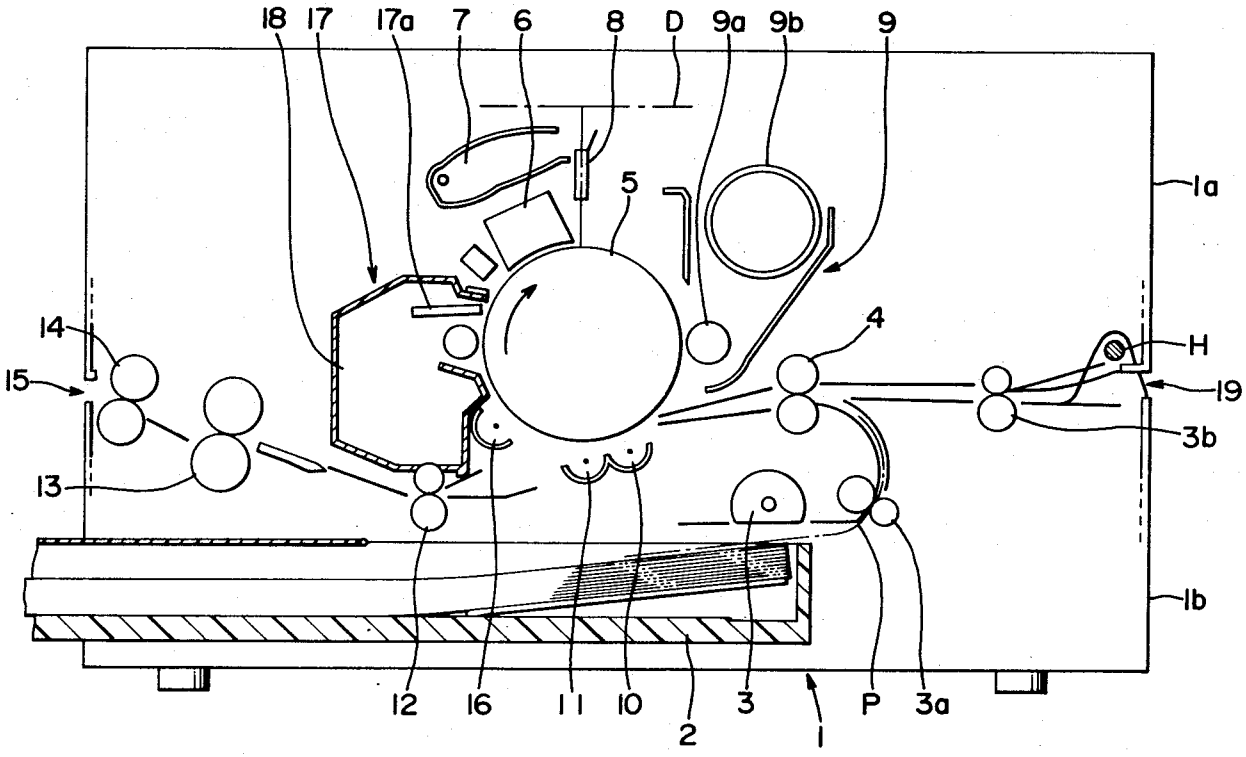
FIG. 1 shows a general internal construction of a reproducing apparatus.
Figure 2:
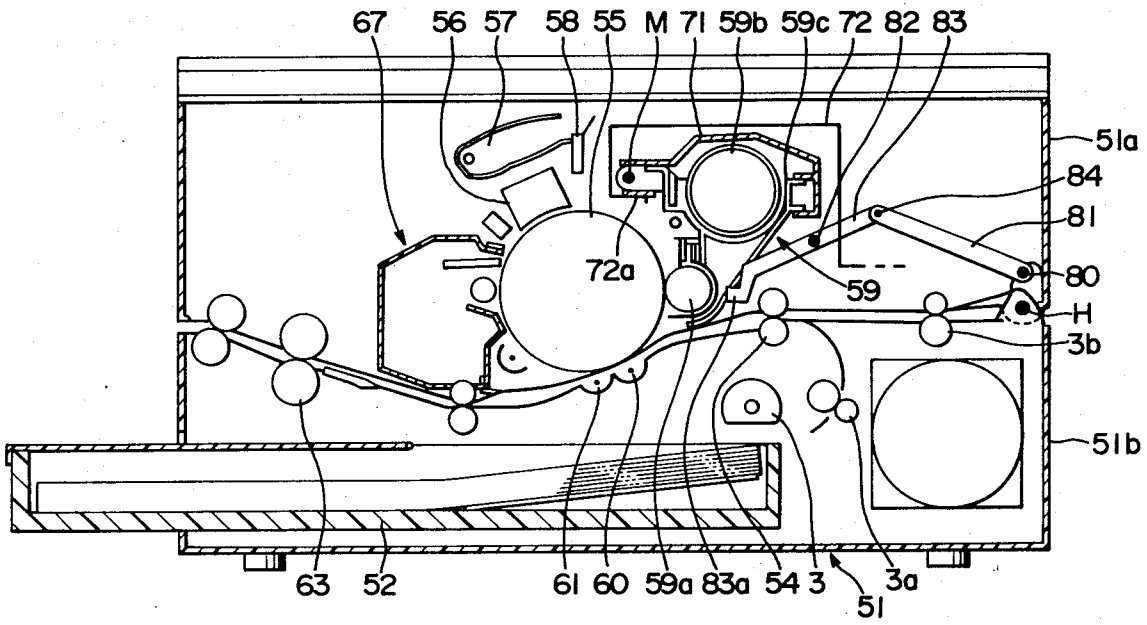
FIGS. 2 and 3 show the operational modes of a two-frame reproducing apparatus according to the present invention, respectively.
Figure 3:
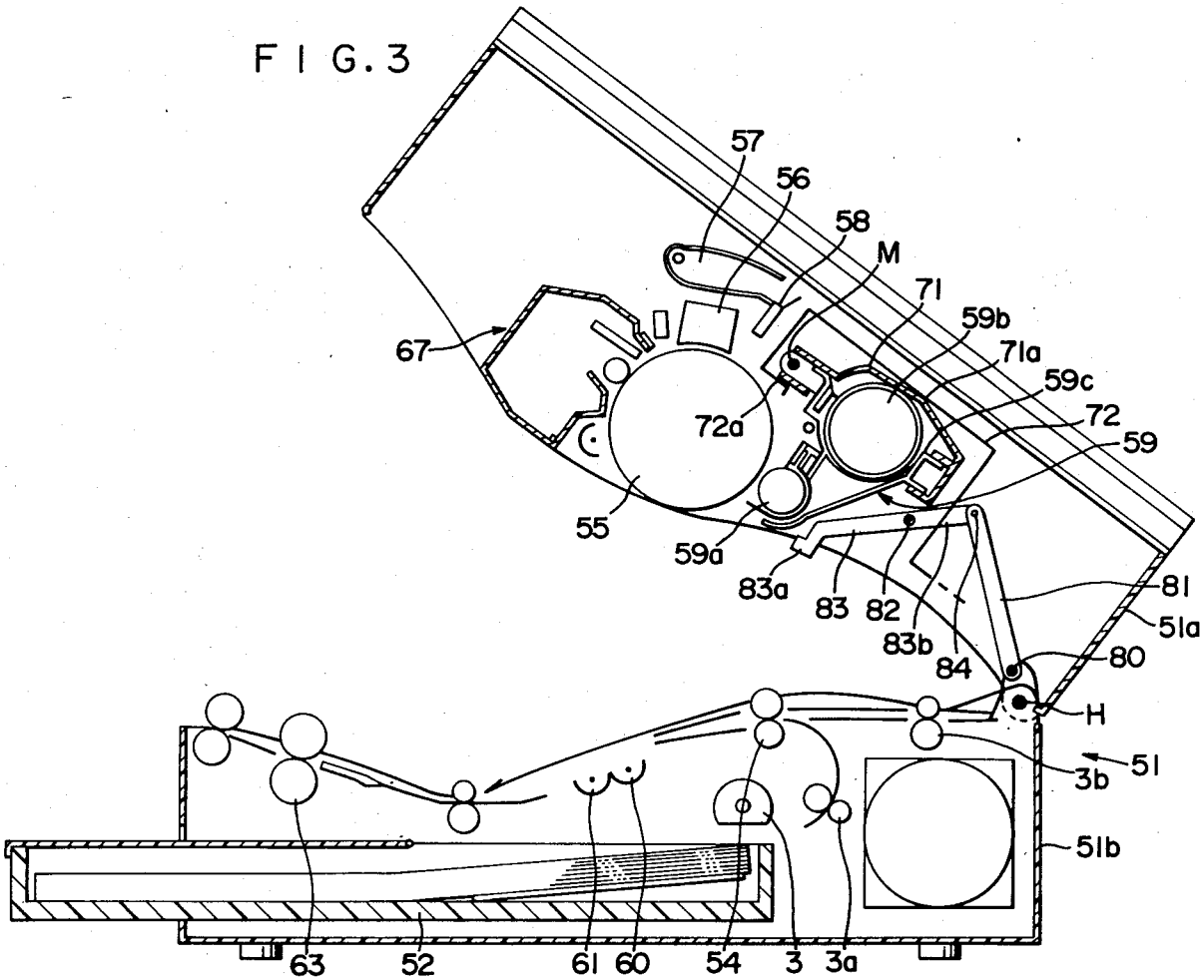

FIGS. 2 and 3 show one embodiment of a two-frame reproducing apparatus provided with a developing device according to the present invention. FIG. 2 shows the state in which the upper frame is closed, while FIG. 3 shows the state in which the upper frame is open to allow checking for faulty paper feed, or for inspecting or replacing components for other purposes.

The two-frame reproducing apparatus 51 shown in FIG. 2 has a construction in which an upper frame 51*a* housing an image-forming process member is divided from a lower frame 51*b* by a plane of conveyance of recording paper which ranges from a port for manual paper feeding to a paper-ejection port, and the two frames are coupled by a hinge shaft H so that the upper frame 51*a* can be opened freely.

The upper frame 51*a* houses a photosensitive drum 55 working as the image-forming process member, to begin with, and a charging electrode 56, an exposure lamp 57, a converging phototransmission element 58, a cleaning device 67 and a developing device 59, etc. while the lower frame 51*b* houses conveyance roller groups beginning with a second paper-feeding roller 54 and a fixing roller 63 both working as paper-feeding and conveyance members, electrodes 60 and 61 employed for image transfer and separation, a paper-feeding cassette 52, and a driving power source, etc.

Moreover, according to the present invention, a developing casing 59*c* of the developing device 59 housed in the upper frame 51*a* is held by a guide rail 71 fitted to the casing from outside, and the developing casing 59*c* and the guide rail 71 are constructed so that they can rotate together around a shaft M which is fixed to said upper frame 51*a*. When the reproducing apparatus 51 is put in the state of operation with the upper frame 51*a* closed, as shown in FIG. 2, said developing casing 59*c* and guide rail 71 are subjected to the moment of clockwise rotation around the shaft M generated by gravity, and thereby the guide rail 71 is brought into contact with and stopped at the end portion 72*a* of a panel 72 which is fixed to the inside of the upper frame 51*a*.

Moreover, a lever 81 having the rotational center 80 in the lower frame 51*b* and a lever 83 having the rotational center 82 in the upper frame 51*a* are coupled rotatably with each other by a joint 84, and this joint 84 is made to actuate said lever 83 in the clockwise direction by the action of a tension spring which is stretched between the joint and the upper frame 51*a*. By this action, the end portion 83*a* of the lever 83 is made to press the outer wall of said developing casing 59*c*, and thus a setting member which ensures further the positioning of the developing device 59 at a prescribed position of development is formed. Therefore the developing sleeve 59*a* is separated with an appropriate gap from the photosensitive drum 55 so that it can serve the function of developing a latent image on the photosensitive drum 55 with toner which is supplied from a toner cartridge 59*b*. As is known publicly, said gap is about 1 mm when development is conducted with a one-component developer, and is several millimeters when the development is conducted with a two-component developer.

Next, when the upper frame 51*a* is opened in the clockwise direction to form an angle of about 45 degrees to the lower frame as shown in FIG. 3, it is locked in the opened state by a stay device (not shown in the figure) provided between the upper and lower frames 51*a* and 51*b* and is stopped in the state shown in FIG. 3.

Then the developing casing 59*c* and the guide rail 71 rotate under the moment of counterclockwise rotation around the shaft M generated by the gravity, and said guide rail 71 separates from said end portion 72*a* and stops with its top 71*a* in contact with the inner wall of the panel 72.

At that time, the lever 81 is rotated around the rotational center 80 and simultaneously the lever 83 is rotated counterclockwise with the movement of the rotational center 82 which is caused by the rotation of the upper frame 51*a*. Consequently the side end portion 83*b* of said lever 83 is made to act to push up one end of the developing casing 59*c*, and thus said developing casing 59*c* and guide rail 71 are moved back positively and easily.

In this way, the developing device 59 can be shifted to the position of development or a moved-back position by its own weight by closing or opening the upper frame 51*a* in the reproducing apparatus 51. At the same time, by the action of the setting member which is composed of said levers 81 and 83 and, preferably, the tension spring (not shown in the figure) which actuates downward the joint 84 coupling the lever 81 with the lever 83, the developing device 59 is maintained exactly at the position of development, while it can be shifted still more easily and surely.

According to the present invention, it is also possible to set the developing sleeve 59*a* of the developing device 59 apart widely from the outer peripheral surface of the photosensitive drum 55 and thereby to make the gap between them large enough to permit the replacement, removal and mounting of the drum.

Therefore, there is no danger of damaging the surface of the drum due to the contact of the outer peripheral surface thereof with the developing device 59 which otherwise tends to occur when the drum is removed and mounted for replacement. On the other hand, since said developing device 59 is guided together with the shaft M so that it can be removed and fitted in parallel with the outer peripheral surface of the photosensitive drum 55 along the guide rail 71, the inspection, cleaning or the supply of toner can be performed easily without damaging the outer peripheral surface of the drum. While the developing device is set through a guide plate from the lateral direction of the main body of the reproducing machine in the present embodiment, it can be set also by a method in which it is inserted from the upper part of the reproducing machine from which a document stage provided thereon is removed. In this case, the part of the machine above the bearing is opened and the shaft provided in the developing device is set thereon.

Figure 4:
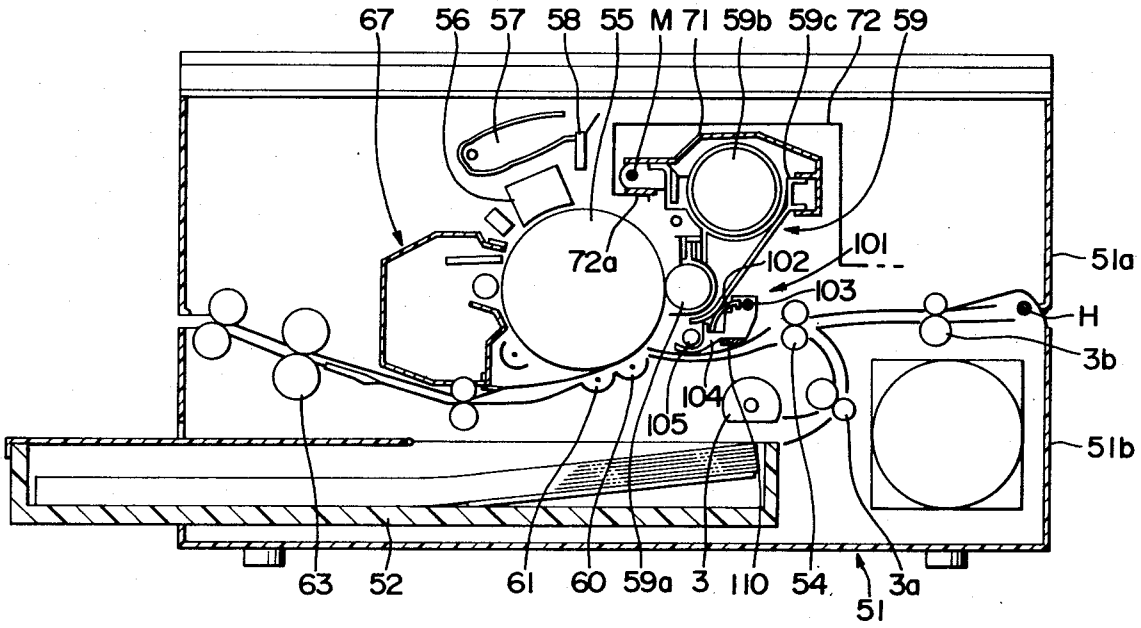
FIGS. 4 and 5 show the operational modes of another embodiment of the present invention, respectively.
Figure 5:
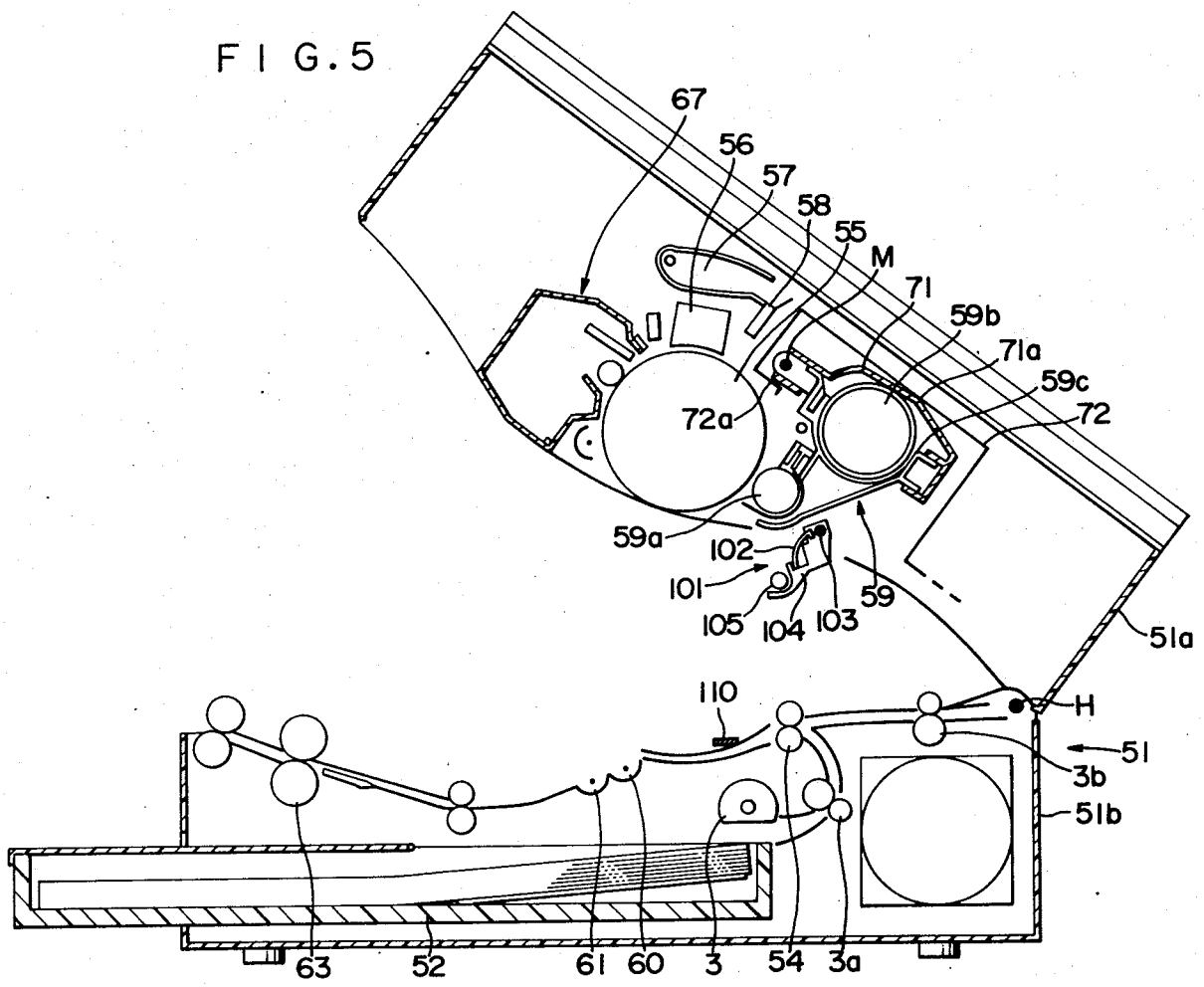

FIGS. 4 and 5 show another embodiment of the present invention which enables the attainment of the same purpose. In this embodiment, a spring member is provided as an actuating member which presses the developing device close at a prescribed distance to the surface of the photosensitive drum. This spring member is formed of a spring board 102. Furthermore, a swingable member 101 which can swing around a shaft 103 provided in a part of the upper frame 51*a* is fitted on the front and back sides of the developing device 59. In the present embodiment, the swingable member 101 is provided particularly with a pretransfer exposure lamp 105, which is fitted in the longitudinal direction of the member 101 (in the direction vertical to the sheet of the figure) and on the drum 55 side of a frame 104 of this member. The spring board 102 is fixed on the side near the shaft 103, while the other end thereof is made free, and when the upper frame 51*a* is lowered and thereby the machine is set operable, as shown in FIG. 4, the flat surface of the spring board 102 acts to push up the developing device 59. In this state, the swingable member 101 is controlled so as not to be lowered further by a stopper member 110 which is fixed to the lower frame 51*b*. This stopper 110 may be replaced by a part of the lower frame 51*b* or any other fitting. Next, when the upper frame 51*a* is opened as shown in FIG. 5, the swingable member 101 is separated from the stopper member 110 and rotates counterclockwise around the shaft 103, and subsequently the developing device 59 actuated theretofore by the spring board 102 also rotates counterclockwise around the shaft M, thus the gap between the photosensitive drum 55 and the developing device 59 being expanded.

In addition to the construction in which a link mechanism or the spring member is employed as a means for pressing the developing device and in which the developing device is separated from an image carrying body by its own weight when the upper frame is opened, any other pressing means may be used in this embodiment, and also any other means for separating said developing device may be used therein together with said means using the own weight of the developing device.

As described above, the present invention can provide a two-frame reproducing apparatus which has a simple structure and can shift the developing device automatically to the position of development or to the moved-back position with the opening or closure of the reproducing apparatus by using gravity and a setting member helping the action of gravity, and which facilitates and safeguards mounting and checking, the photosensitive drum.

What is claimed is:

1. In a reproducing apparatus comprising an upper frame having at least an image retainer and a developing device arranged near said image retainer for developing with toner a latent image on said image retainer, and a lower frame engaging at one portion thereof with said upper frame, said upper frame being can be displaced relative to said lower frame, the improvement characterized in that said developing member being separated from the surface of said image retainer by the displacement of said upper frame.

2. The reproducing apparatus as claimed in claim 1, wherein said developing device is separated from the surface of said image retainer in cooperation with the displacement of said upper frame.

3. The reproducing apparatus as claimed in claim 1, wherein said developing device is separated from the surface of said image retainer by a motion of the displacement of said upper frame.

4. The reproducing apparatus as claimed in claim 1, wherein said upper frame member is engaged rotatably with an end of said lower frame, and an end of said upper frame opposite to the engaging portion thereof is movable upwards centering around said engaging portion in the displaced state.

5. The reproducing apparatus as claimed in claim 4, wherein said developing device is mounted so as to swing centering about one portion thereof as an axis on said upper frame, and to be swung centering about said axis by the gravity thereof when said upper frame is separated from said lower frame, so that the developing device separates from the surface of said image retainer.

6. The reproducing apparatus as claimed in claim 2, wherein said developing device can be installed in and removed from said upper frame in said displaced state of said upper frame.

7. The reproducing apparatus as claimed in claim 5, wherein said developing device can be installed in and removed from said upper frame in said displaced state of said upper frame.

8. The reproducing apparatus as claimed in claim 1, wherein said upper frame has a pressing means, and for pressing said developing member toward the surface of said image retainer, and the pressing force of said pressing means is reduced depending upon the displacement of said upper frame with respect to said lower frame.

9. The reproducing apparatus as claimed in claim 1, wherein said pressing means is a spring member.

10. The reproducing apparatus as claimed in claim 4, wherein said pressing means is a spring member.

11. The reproducing apparatus as claimed in claim 10, wherein said developing device is displaced by the gravity thereof against the pressing force of said spring member on the way of separating of said upper frame from said lower frame, so that said developing device separates from the surface of said image retainer.

12. The reproducing apparatus as claimed in claim 5, wherein said pressing means is a linking means mounted at one end thereof rotatably on one portion of said upper frame, said linking means swinging in cooperation with the separating motion of said upper frame, so that the pressing force exerted on said developing means by the other end of said linking means is removed.

13. In a reproducing apparatus comprising an upper frame having at least an image retainer and an image forming device arranged a predetermined distance apart from said image retainer, and a lower frame, said upper frame being movable relative to said lower frame, the improvement characterized in that when said upper frame is in a displaced state said image forming device is separated further from the surface of said image retainer.

14. The reproducing apparatus as claimed in claim 13, wherein said image forming device is a developing device.

15. The reproducing apparatus as claimed in claim 13, wherein said upper frame is engaged rotatably with an end of said lower frame, and an end of said upper frame opposite to the engaging portion thereof is movable upwards centering around said engaging portion in the displaced state.

16. The reproducing apparatus as claimed in claim 15, wherein said developing device is mounted so as to swing centering about one portion thereof as an axis on said upper frame, and swung centering about said axis by the gravity thereof when said upper frame is separated from said lower frame, so that the developing device separates from the surface of said image retainer.

17. The reproducing apparatus as claimed in claim 13, wherein said image forming device is a cleaning device for removing a toner remained on said image retainer.

18. The reproducing apparatus as claimed in claim 17, wherein said cleaning device is mounted so as to swing centering about one portion thereof as an axis on said upper frame, and swung centering about said axis by the gravity thereof when said upper frame is separated from said lower frame, so that the cleaning device separates from the surface of said image retainer.

19. In a reproducing apparatus comprising an upper frame having at least an image retainer and a developing device arranged near said image retainer for developing a latent image on said image retainer, and a lower frame engaging at one portion thereof with said upper frame, said upper frame being rotatable relative to said lower frame centering around said engaging portion upwards from a position at which the recording is carried out, the improvement characterized in that said developing device is rotatable with respect to said upper frame centering about a longitudinal axis of said developing device and that said developing device is separated from said image retainer by the rotation of said upper frame relative to said lower frame.

20. A reproducing apparatus comprising an upper frame for holding at least an image retainer and a developing device, a lower frame for pivotably supporting said upper frame, said upper frame being movable between an operating position and a release position, and a supporting means for supporting said developing device, said device being freely movably in a direction perpendicular to an axis of said image retainer, whereby said developing device is automatically moved away from said image retainer under the influence of gravity when said upper frame is not in the operating position.

21. The apparatus of claim 20 wherein said developing means is pivotable about an axis parallel to the axis of the image retainer.

22. The apparatus of claim 20 further comprising a biasing means for urging said developing device toward said image retainer when said upper frame is in the operating position.

23. The apparatus of claim 22 wherein said biasing means is released by release movement of the upper frame.

24. The apparatus of claim 22 wherein said biasing means is a spring member.

25. The apparatus of claim 22 further comprising a stop for limiting movement of said developing device when said upper frame is in the operating position.

26. The apparatus of claim 23 further comprising a stop for determining a position of said developing device when said upper frame is in the operating position.

27. The apparatus of claim 20 wherein an edge of said upper frame engages a corresponding edge of said lower frame.

28. The apparatus of claim 23 wherein said developing device is slidable in a direction parallel to the axis of the image retainer.

29. The apparatus of claim 28 wherein said biasing means prevents said developing means from being slid when the upper frame is in the operating position.

30. The apparatus of claim 23 wherein said biasing means is a linking means which moves co-operatively with the upper frame.

* * * * *